United States Patent [19]

Beghi

[11] Patent Number: 4,768,752

[45] Date of Patent: Sep. 6, 1988

[54] DRIVING APPARATUS OPERATING IN SUCCESSIVE STEPS

[75] Inventor: René Beghi, Nanterre, France

[73] Assignee: Kley France, Nanterre, France

[21] Appl. No.: 1,636

[22] PCT Filed: Jun. 20, 1986

[86] PCT No.: PCT/FR86/00214

§ 371 Date: Dec. 4, 1986

§ 102(e) Date: Dec. 4, 1986

[87] PCT Pub. No.: WO86/07583

PCT Pub. Date: Dec. 31, 1986

[30] Foreign Application Priority Data

Jun. 21, 1985 [FR] France ..... 85 09446

[51] Int. Cl.[4] ..... F21B 19/00

[52] U.S. Cl. ..... 254/29 A

[58] Field of Search ..... 254/29 A, 29 R, 106; 29/452; 52/223 R, 223 L

[56] References Cited

U.S. PATENT DOCUMENTS 3,653,634 4/1972 Bechi ..... 254/29 A 3,954,005 5/1976 Edwards ..... 254/29 A 4,274,618 6/1981 Orr ..... 254/29 A

*Primary Examiner*—Frederick R. Schmidt

*Assistant Examiner*—Judy J. Hartman

[57] ABSTRACT

Driving apparatus operating in successive steps, comprising two clamping assemblies each having a set of clamping members for clamping a set of cables in alternate succession, and at least one hydraulic jack connected to at least one of the two clamping assemblies in order to cause axial displacement thereof, each clamping assembly comprising an auxiliary jack having a piston rod and a cylinder which is attached coaxially to one end of a tubular body of the corresponding clamping assembly and provided with longitudinal passageways for the cables, and coupling members for coupling the piston rod of the auxiliary jack to the set of clamping members of the corresponding clamping assembly, the coupling members being so constructed that all the clamping members of the set are free to move radially, but are caused by the piston rod to move simultaneously over the same distance of travel in the axial direction when the auxiliary jack is actuated.

4 Claims, 2 Drawing Sheets

DRIVING APPARATUS OPERATING IN SUCCESSIVE STEPS

BACKGROUND OF THE INVENTION

1. Field of the Invention

The present invention relates to a driving apparatus operating in successive steps, comprising two clamping assemblies which are located in alignment with each other, each clamping assembly comprising a tubular body having an inner surface which is inclined with respect to the longitudinal axis of said tubular body, and a set of clamping members located in circumferentially spaced relation within the tubular body and having an outer surface which has the same slope as the inner surface of said tubular body, so that a relative axial displacement of the set of clamping members in either one direction or the other with respect to the tubular body produces a clamping or unclamping action, respectively on a plurality of cables whith which the driving apparatus is intended to cooperate in order to displace a load, each cable extending in a direction parallel to the axis of the tubular body and passing between two adjacent clamping members of each of the two sets of clamping members, and at least one hydraulic jack coupled to at least one of the two clamping assemblies in order to produce an axial displacement thereof.

2. Description of the Prior Art

The invention is more particularly concerned with a driving apparatus of the type described in French Pat. No. Fr-2,063,477. (U.S. Pat. No. 3,653,634). As shown in particular in FIG. 1 of the cited patent, the outer surfaces of all the clamping members 15 or so-called keys of the two clamping assemblies 11 and 13 all converge in the same direction $F_1$. The operation of this known driving apparatus does not usually present any problem when it is necessary to exert a tractive force on a set of cables 5 in a direction $F_2$ opposite to the direction $F_1$ as is the case with prestressing of a concrete beam. It is an entirely different matter when a load has to be displaced both in the direction of the arrow $F_2$ and in the direction of the arrow $F_1$ in order to raise and lower said load, for example. In fact, since the driving apparatus is used in that case in a vertical position and the downward displacement of the load takes place in the direction of the arrow $F_1$, when the piston 12 of the hydraulic jack and the clamping assembly 13, which is fixed to the tubular piston rod 14 of said jack and holds the cables 5, are allowed or caused to move all together in this direction with a view to lower the load, the clamping members 15 of the clamping assembly 11 have a tendency, under the action of their own weight and under the action of the friction forces exerted thereon by the cables 5, to move also in the direction of the arrow $F_1$ with respect to the tubular body 11*a* of the clamping assembly 11 which is fixed. Therefore, the clamping members 15 of the clamping assembly 11 have a tendency to clamp and actually do clamp the cables 5, thus impeding any displacement of said cables 5 and of the load attached thereto in the direction $F_1$. Furthermore, when the piston 12 is displaced in the aforesaid direction $F_1$ and is accompanied in this movement by the tubular body 13*a* of the clamping device 13, the friction forces set up between the cables 5 and the clamping members 15 of the clamping device 13 are liable to cause a relative displacement of said clamping members 15 with respect to the body 13*a* in the direction of the arrow $F_2$ and consequently to cause unclamping of the cables 5 which are no longer retained by the clamping device 13 in such a case.

SUMMARY OF THE INVENTION

The object of the present invention is therefore to provide a driving apparatus of the above-mentioned type, which is capable of displacing a load in two opposite directions, for example with a view to raising and lowering said load.

To this end, the driving apparatus of the present invention is characterized in that each of the two clamping assemblies further comprises an auxiliary jack having a piston rod and a cylinder, said cylinder being attached coaxially to one end of the tubular body of the corresponding clamping assembly and having longitudinal passageways for the cables, and coupling means for coupling the piston rod of the auxiliary jack to the set of clamping members of the corresponding clamping assembly, said coupling means being so constructed that all the clamping members of said set are free to move radially, but are caused by the piston rod to move simultaneously over the same distance of travel in the axial direction when the auxiliary jack is actuated.

BRIEF DESCRIPTION OF THE DRAWINGS

These and other features of the invention will be more apparent to those skilled in the art upon consideration of the following description and accompanying drawings, wherein.

DESCRIPTION OF THE PREFERRED EMBODIMENT OF THE INVENTION

Figure 1:
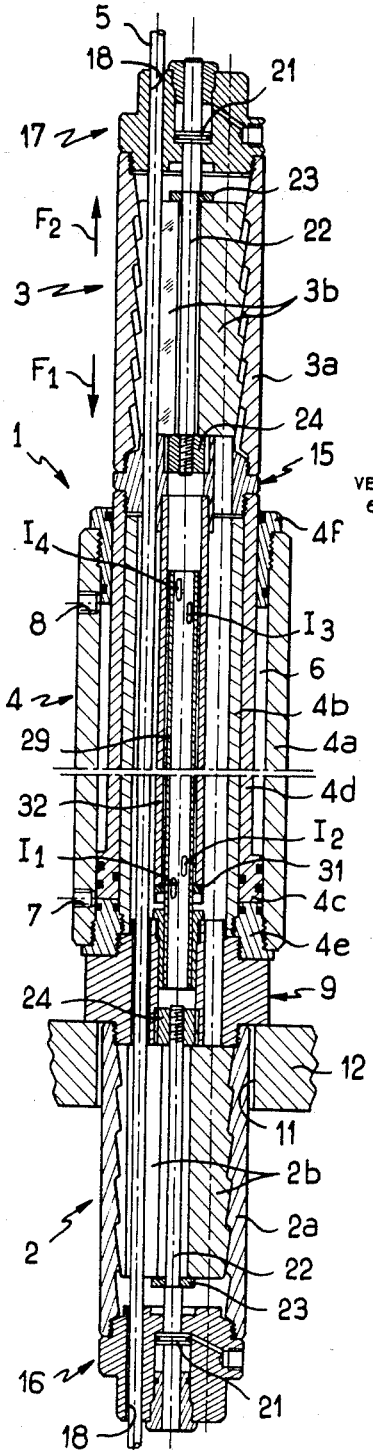
FIG. 1 is an axial section view showing an embodiment of a driving apparatus of the present invention.
Figure 2:
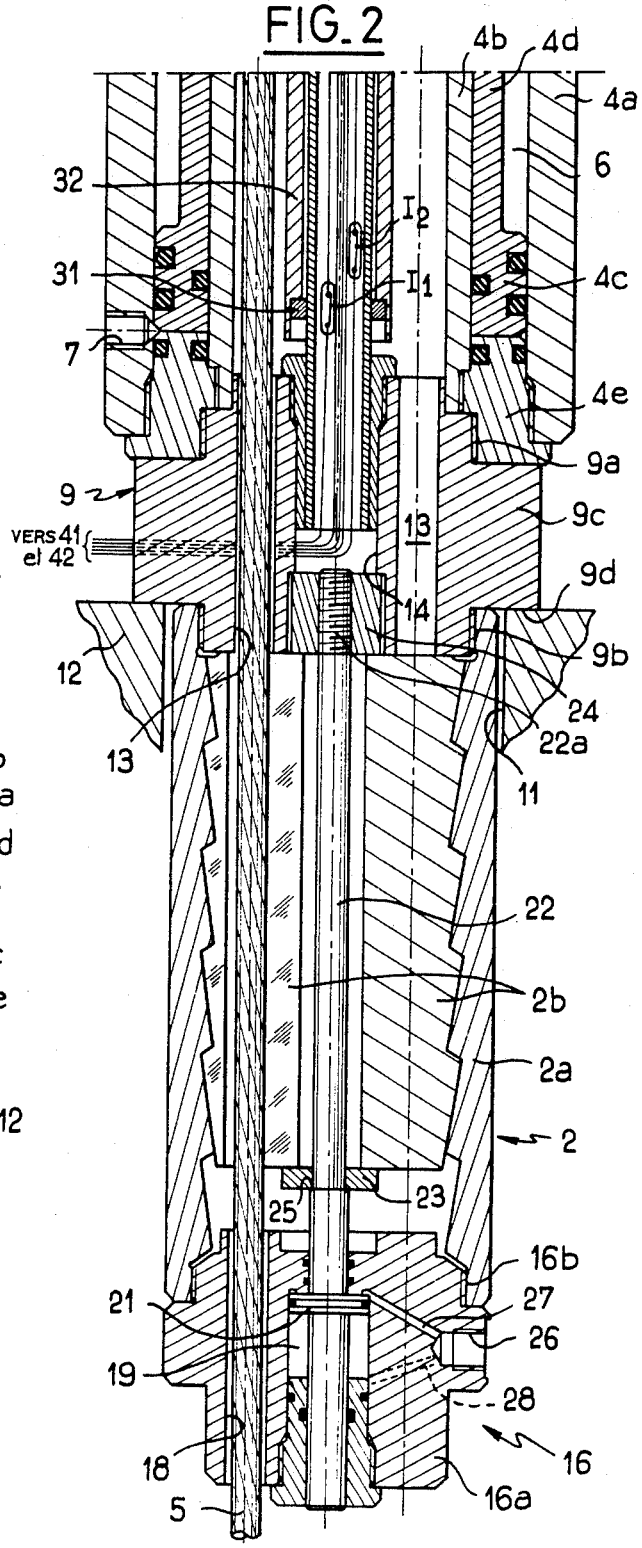
FIG. 2 is an axial section view to a larger scale showing part of the driving apparatus of FIG. 1.

The driving apparatus 1 shown in FIG. 1 comprises in a known manner two clamping assemblies 2 and 3 and a hydraulic jack 4, these three elements being located in coaxial alignment with each other. Each of the two clamping assemblies 2 and 3 has a structure which is similar to that described in French Pat. No. Fr-2,063,477 (U.S. Pat. No. 3,653,634) and essentially comprises a tubular body 2*a* or 3*a*, respectively, and a set of clamping members or keys 2*b* or 3*b*, respectively. It will be apparent that the number of keys 2*b* and the number of keys 3*b* is equal to the number of cables 5 with which the driving apparatus is intended to cooperate (only one cable 5 is shown in FIGS. 1 and 2).

The hydraulic jack 4 comprises two concentric tubes 4*a* and 4*b* defining therebetween an annular space 6, in which an annular piston 4*c* is slidably mounted. Piston 4*c* is attached to one end of a tubular piston rod 4*d* or else may be integral with said piston rod. The space 6 is closed by means of an annular plug 4*e* at one end of the tubes 4*a* and 4*b* and is closed at the other end by means of another annular plug 4*f* having a central opening in which the tubular piston rod 4*d* is slidably mounted in leak-tight manner. A fluid under pressure can be admitted into the space 6 above and beneath the piston 4*c* respectively through inlet orifices 7 and 8 of the tube 4*a*.

The annular plug 4*e* has an internally-threaded end portion which is screwed onto one externally-threaded end portion 9*a* of a coupling member 9. The other externally-threaded end portion 9b of said coupling member is screwed into an internally-threaded portion provided at the upper end of the tubular body 2a of the clamping assembly 2 (as best shown in FIG. 2). Between its end portions 9a and 9b, the coupling member 9 has a portion 9c of larger diameter forming an annular shoulder 9d by which the driving apparatus is supported on the edge of an opening 11 provided in a stationary frame 12. If so desired, the coupling member 9 could have a width greater than that shown in FIG. 2 and could be secured to the frame 12 by fixing means such as bolts. The coupling member 9 is provided with a plurality of longitudinal passageways 13 (one passageway being provided per cable 5) which are disposed in circumferentially spaced relation and in which the cables 5 are permitted to pass freely, and with an axial bore 14, the usefulness of which will hereinafter become more clearly apparent.

Another coupling member 15 (shown in FIG. 1) which is similar to the coupling member 9 joins the piston rod 4d of the hydraulic jack 4 to the tubular body 3a of the clamping assembly 3.

In the driving apparatus of the present invention, two auxiliary hydraulic jacks 16 and 17 are associated with the clamping assemblies 2 and 3, respectively, for the purpose of producing a displacement of the keys 2b and the keys 3b, respectively, between a first position in which the keys clamp the cables 5 and a second position in which said keys unclamp or release said cables 5. In FIG. 1, the keys 3b, are shown in the first position or clamping position whilst the keys 2b are shown in the second position or unclamping position.

The two auxiliary jacks 16 and 17 are identical and are coupled in the same manner respectively to the keys 2b of the clamping assembly 2 and to the keys 3b of the clamping assembly 3. Under these conditions, there will now be described in detail only the jack 16 and the way in which this latter is coupled to the keys 2b, reference being made to FIG. 2. The body or cylinder 16a of the jack 16 is provided at one end with an externally threaded portion 16b which is screwed into an internally threaded portion provided at the lower end of the tubular body 2a of the clamping assembly 2. A plurality of longitudinal passageways 18 equal in number to the cables 5 and located in circumferentially spaced relation at uniform intervals are provided within the body 16a in order to allow the cables 5 to pass freely through said passageways. A piston 21 secured to a piston rod 22 which extends within an axial passage located at the center of the set of keys 2b is slidably fitted within the chamber 19 of the jack 16. The piston rod 22 is coupled to the set of keys 2b by means of two annular thrust-bearing members 23 and 24 which are axially spaced on the piston rod 22 and each adapted to cooperate with one of the end faces of the keys 2b. The thrust-bearing member 23 which is nearest the piston 21 can be constituted, for example, by a washer bearing against an annular shoulder 25 of the piston rod 22 whilst the thrust-bearing member 24 which is farthest from the piston 21 can be constituted, for example, by a nut which is screwed on a threaded end portion 22a of the piston rod 22.

In this manner, each of the keys 2b is free to move radially with respect to the piston rod 22, but all the keys 2b are caused by the piston rod 22 to move simultaneously over the same distance of travel in the axial direction when the auxiliary jack 16 is actuated. An orifice 26 and a duct 27 are provided in the body 16a of the jack 16 in order to admit a fluid under pressure into the chamber of the jack 16 above the piston 21 and consequently in order to produce a downward displacement of the keys 2b with respect to the tubular body 2a of the clamping assembly 2, thereby clamping the cables 5 by means of said keys 2b. Similarly, another orifice which is similar to the orifice 26, but displaced angularly with respect to this latter, and another duct 28 are provided in the body 16a in order to admit the fluid under pressure into the chamber 19 beneath the piston 21 and consequently in order to produce an upward displacement of the keys 2b with respect to the tubular body 2a of the clamping assembly 2, thereby moving the keys 2b to their unclamping position.

A first pair of switches $I_1$ and $I_2$ and a second pair of switches $I_3$ and $I_4$ (shown in FIG. 1) are mounted within a tube 29 which is fixed at one end thereof within the central bore 14 of the coupling member 9 and which extends coaxially within the inner tube 4b of the hydraulic jack 4. The switches $I_1$ and $I_4$ are located in positions corresponding to the lower and upper ends respectively of the stroke of the piston 4c. The switches $I_2$ and $I_3$ are located respectively above the switch $I_1$ and below the switch $I_4$ at a short axial distance from these latter. This distance corresponds approximately to the axial distance of travel of the keys 2b and 3b with respect to the tubular bodies 2a and 3a respectively, between their clamping and unclamping positions. By way of example, the switches $I_1$ to $I_4$ can be of a type in which a movable contact-strip can be actuated by a permanent magnet. In this case, a permanent magnet 31 of annular shape is secured to one end of a tube 32, the other end of said tube being attached to the coupling member 15 which is movable with the piston rod 4d of the hydraulic jack 4. The tube 32 is placed concentrically around the tube 29 and is capable of sliding on this latter when the hydraulic jack 4 is actuated. The tubes 29 and 32 are of non-magnetic material.

Figure 3:
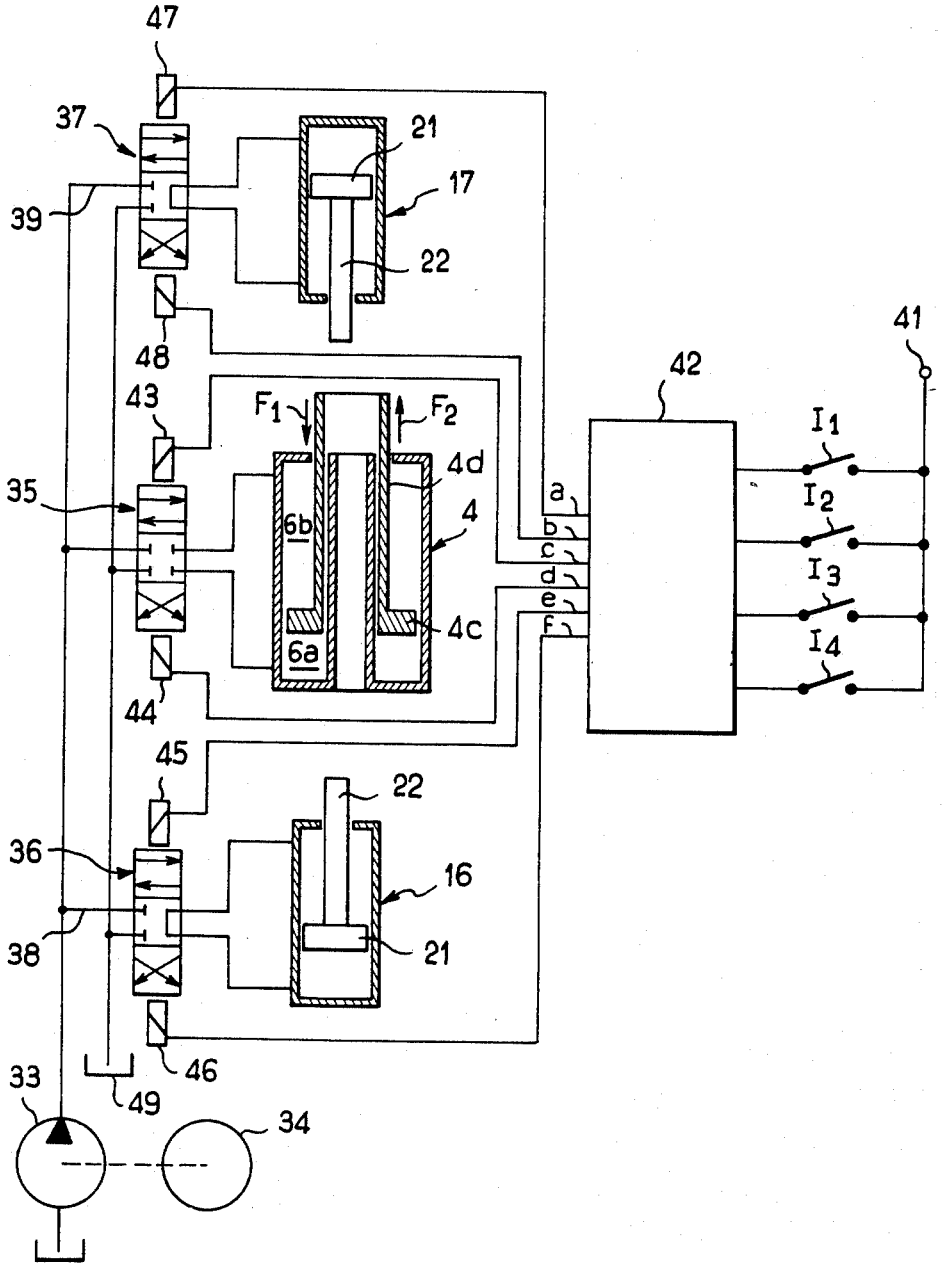
FIG. 3 is a diagram showing the electric and hydraulic control circuits of the driving apparatus of FIG. 1.

FIG. 3 is a highly schematic representation of the hydraulic and electric circuits which control the operation of the jacks 4, 16 and 17. A hydraulic pump 33 driven by a motor 34 such as an electric motor, for example, supplies the jacks 4, 16 and 17 with fluid under pressure via three electrovalves 35, 36 and 37 respectively. Each electrovalve has a neutral position and two work positions each corresponding to one direction of displacement of the piston rod of the jack which is associated therewith. Since the jacks 16 and 17 do not need to operate at a pressure as high as that of the jack 4, pressure-limiting devices can be provided within the lines 38 and 39 leading to the electrovalves 36 and 37. Alternatively, the jacks 16 and 17 can be supplied with fluid under pressure by a pump which is separate from the pump used for supplying the jack 4. The four switches $I_1$–$I_4$ are connected electrically on the one hand to a common terminal 41 which is in turn connected to a reference potential, and on the other hand to respective inputs of a sequential control logic circuit 42, the outputs a–f of which are connected to the solenoids 43 to 48 of the electrovalves 35 to 37 so as to control the operation of the jacks 4, 16 and 17 in a predetermined sequence in response to actuation of the switches $I_1$ to $I_4$ by the permanent magnet 31.

The operation of the driving apparatus of the invention for lowering a load attached to the lower end of the cables 5 will now be described. It will be assumed at the outset that the piston 4c of the hydraulic jack 4 is located at the lower end of its stroke, that is to say in the position shown in FIG. 1, that the piston 21 of the jack 16 is also located at the lower end of its stroke and that the piston 21 of the jack 17 is located at the upper end of its stroke. Under these conditions, the keys 2b of the clamping assembly 2 grip the cables 5 and consequently retain said cables together with the load attached thereto. On the other hand, the keys 3b of the clamping assembly 3 do not grip the cables 5 and are therefore capable of sliding with respect to said cables. In the aforementioned position of the piston 4c, the permanent magnet 31 actuates the switch $I_1$ and the sequential control logic circuit 42 activates its output d in order to energize the solenoid 44. Therefore, the fluid under pressure delivered by the pump 33 is now admitted through the electrovalves 35 and the inlet orifice 7 into the lower chamber 6a of the hydraulic jack 4. This produces an upward displacement of the piston 4c in the direction of the arrow $F_2$ and consequently has the effect of lifting the clamping assembly 3, the keys 3b of which slide along the cables 5 without producing any accompanying displacement of said cables. During the upward movement of the piston 4c, the magnet 31 actuates the switch $I_2$ but this does not have any effect on the outputs of the logic circuit 42 since means are provided in said circuit for invalidating the signal resulting from actuation of the switch $I_2$ when said signal is generated prior to operation of the switches $I_3$ and $I_4$. When the piston 4c comes close to the upper end of its stroke, the magnet 31 actuates the switch $I_3$. At this moment, the logic circuit 42 de-activates its output b and activates its output a, with the result that the solenoid 47 of the electrovalve 37 is now in the energized state and that the fluid under pressure is now admitted into the upper chamber of the jack 17. Consequently, the piston rod 22 of the jack 17 produces a downward displacement of the keys 3b of the clamping assembly 3 in order to clamp the cables 5. Clamping of the cables 5 by the keys 3b takes place very rapidly by reason of the fact that, at this moment, the piston 4c, the piston rod 4d and consequently the body 3a of the clamping assembly 3 are still carrying out an upward movement. After a short delay corresponding to the time required for ensuring that the keys 3b clamp the cables 5 in response to actuation of the switch $I_3$, the logic circuit 42 de-activates its output e and activates its output f, with the result that the solenoid 46 of the electrovalve 36 is now energized and that the fluid under pressure is now admitted into the lower chamber of the jack 16. Under these conditions, the clamping assembly 3, the key 3b of which are now griffing the cables 5, draws the cables upwards over a short distance corresponding to the distance between the switches $I_3$ and $I_4$ and the cables 5 are accompanied by the keys 2b of the clamping assembly 2 as a results of frictional contact, the upward movement of the keys 2b being assisted by the piston rod 22 of the jack 16, the piston 21 of which is now thrust in the upward direction.

When the piston 4c of the hydraulic jack 4 arrives at the upper end of its stroke, the keys 2b of the clamping assembly 2 no longer produce a clamping action on the cables 5 and the magnet 31 actuates the switch $I_4$. At this moment, the logic circuit 42 de-activates its output d and activates its output c, with the result that the solenoid 43 of the electrovalve 35 is now energized. Consequently, the fluid under pressure is now admitted into the upper chamber 6b of the hydraulic jack 4 in order to cause a downward displacement of the piston 4c. At this moment, the lower chamber 6a of the hydraulic jack 4 is connected to the tank 49 by means of a flow-limiting device (not shown in the drawings) in such a manner as to ensure that the downward displacement of the piston 4c and consequently the downward movement of the load attached to the cables 5 does not take place too rapidly. During the downward movement of the piston 4c, the magnet 31 again actuates the switch $I_3$ but this has no effect on the outputs of the logic circuit 42 since this circuit is provided with means for inhibiting the signal resulting from actuation of the switch $I_3$ when said signal is generated prior to actuation of the switches $I_2$ and $I_1$.

When the piston 4c arrives near the lower end of its stroke, the magnet 31 actuates the switch $I_2$. At this moment, the logic circuit 42 de-activates its output f and activates its output e, with the result that the solenoid 45 of the electrovalve 36 is now excited and this has the effect of admitting the fluid under pressure into the upper chamber of the jack 16. Consequently, the keys 2b of the clamping assembly 2 are drawn downwards by the piston rod 22 of the jack 16 in order to clamp the cables 5. It will be noted that, at this moment, the cables 5 which continue to accompany the piston 4c and the clamping assembly 3 in their downward movement contribute to produce a downward displacement of the keys 2b by frictional contact therewith and consequently to enhance clamping action of said keys on the cables 5. After a short time-delay which is sufficient to ensure that the keys 2b clamp the cables 5 in response to actuation of the switch $I_2$, the logic circuit 42 de-activates its output a and activates its output b, with the result that the solenoid 48 of the electrovalve 37 is now energized. This has the effect of admitting the fluid under pressure into the lower chamber of the jack 17 in order to produce an upward displacement of the piston 21. Consequently, the keys 3b of the clamping assembly 3 are drawn upwards by the piston rod 22 of the jack 17 while the body 3a of the clamping assembly 3 completes its downward displacement with the piston 4c of the hydraulic jack 4.

When the piston 4c of the hydraulic jack 4 arrives at the lower end of its stroke, the keys 3b of the clamping assembly 3 no longer produce any clamping action on the cables 5 which are now securely gripped by the keys 2b of the clamping assembly 2. At this moment, the magnet 31 actuates the switch $I_1$ and the logic circuit 42 de-activates its output c and activates its output d. Therefore, the solenoid 44 of the electrovalve 35 is energized and the fluid under pressure is now admitted into the lower chamber 6a of the hydraulic jack 4. The piston 4c is then thrust-back in the upward direction and the operating cycle described above starts again and is repeated as many times as may be necessary in order to lower the load to the desired extent.

In order to raise a load, the operation of the driving apparatus of the invention is identical with that of the driving apparatus of French Pat. No. FR-2 063 477 (see page 9, line 38 to page 11, line 7 of the patent just mentioned). In this case, it is not absolutely essential to actuate the jacks 16 and 17 in order to bring the keys 3b to their clamping position and in order to bring the keys 2b to their unclamping position when the piston 4c of the hydraulic jack 4 and the clamping assembly 3 are displaced upwards (in the direction of the arrow $F_2$), and in order to bring the keys 2b to their clamping position and the keys 3b to their unclamping position when the jack 4c and the clamping assembly 3 are displaced downwards (in the direction of the arrow $F_1$). In fact, the friction between the cables 5 and the keys 2b and 3b is normally sufficient to cause clamping and unclamping of the cables 5 by the keys 2b and 3b, respectively in an alternate sequence, depending on the direction of displacement of the piston 4c and of the clamping assembly 3. It is therefore only necessary in this case to establish a connection between the two chambers of each of the two jacks 16 and 17 in order to allow their piston rods 22 and consequently the keys 2b and 3b to move freely in the axial direction. However, in a different arrangement which it is clearly possible to adopt if so required, the jacks 16 and 17 can also be employed for initiating clamping and unclamping of cables 5 by means of the keys 2b and 3b respectively and in alternate sequence when the driving apparatus is employed for raising a load attached to the cables in order to obtain a higher degree of safety in this mode of operation.

It will be readily apparent that the embodiment of the present invention as described in the foregoing has been given solely by way of example and not in any limiting sense. Accordingly, any number of modifications can readily be made by those versed in the art without thereby departing either from the scope or the spirit of the present invention as defined in the following claims. From this it follows in particular that, instead of making use of a single hydraulic jack 4 of tubular shape which surrounds the set of cables 5 in concentric relation thereto, it is possible to employ a plurality of hydraulic jacks. By way of example, two hydraulic jacks can be placed respectively on each side of the set of cables. In this case, the coupling members 9 and 15 can be designed in the form of parallel plates, the cylinders of the two hydraulic jacks being accordingly attached to one of the two plates and their piston rods being attached to the other plate. Furthermore, although the driving apparatus described in the foregoing is of the type designed for intermittent operation (the cables 5 being displaced in the upward or downward direction only during the upward stroke or only during the downward stroke of the piston of the hydraulic jack 4), the driving apparatus of the present invention can be so designed as to provide continuous operation. In this case, instead of being rigidly fixed to the cylinder of the hydraulic jack 4, the clamping assembly 2 is movable and is connected to the piston rod of another hydraulic jack, the cylinders of the hydraulic jacks which are associated respectively with the two clamping assemblies 2 and 3 being attached to a common frame.

I claim:

1. A driving apparatus operating in successive steps, comprising: two clamping assemblies which are located in alignment with each other, each clamping assembly comprising a tubular body having an inner surface arranged at a slope with respect to the longitudinal axis of said tubular body, and a set of clamping members located in circumferentially spaced relation within the tubular body and having an outer surface which has the same slope as the inner surface of said tubular body, so that a relative axial displacement of the set of clamping members in one direction or the other with respect to the tubular body produces a clamping or unclamping action, respectively, on a plurality of cables with which the driving apparatus is intended to cooperate in order to displace a load, each cable being adapted to extend in a direction parallel to the axis of the tubular body and to pass between two adjacent clamping members of each of the two sets of clamping members, and at least one hydraulic jack which is coupled to the tubular body of at least one of the two clamping assemblies in order to produce an axial displacement thereof, each of the two clamping assemblies further comprising an auxiliary jack for controlling the relative axial displacement of the set of clamping members with respect to the tubular body of the clamping assembly, said auxiliary jack having a piston rod and a cylinder, said cylinder being attached coaxially to one end of the tubular body of the corresponding clamping assembly and having longitudinal passageways for the cables, said piston rod extending coaxially to the set of clamping members of the corresponding clamping assembly, and coupling means for coupling the piston rod of the auxiliary jack to the set of clamping members of the corresponding clamping assembly, said coupling means being so constructed that all the clamping members of said set are free to move radially with respect to the piston rod of the auxiliary jack, but are caused by the piston rod to move simultaneously over the same distance of travel in the axial direction when the auxiliary jack is actuated.

2. Driving apparatus according to claim 1, wherein the piston rod of said auxiliary jack extends within an axial passage located at the center of the set of clamping members, and wherein said coupling means comprises two annular thrust-bearing members which are axially spaced on the piston rod of the auxiliary jack and are each adapted to cooperate with one end of the clamping members.

3. Driving apparatus according to claim 2, wherein one of the two thrust-bearing members is constituted by a nut screwed onto one end of the piston rod of the auxiliary jack which is remote from a piston of said auxiliary jack while the other thrust-bearing member is constituted by a washer bearing against an annular shoulder of said piston rod.

4. Driving apparatus according to claim 1, wherein the hydraulic jack has a cylinder, which is rididly fixed to the tubular body of one of the two clamping assemblies, and a piston rod which is attached to the tubular body of the other clamping assembly, and said driving apparatus further comprising a first pair of switches located in axially spaced relation near one end of the stroke of the piston rod of the hydraulic jack, and a second pair of switches located in axially spaced relation near the other end of said stroke, a control element which is secured to the piston rod of the hydraulic jack and is capable of moving with said piston rod in order to actuate the switches successively in relation to the position of the piston rod, a hydraulic fluid source electrovalves connecting the hydraulic jack and the auxiliary jacks to said hydraulic fluid source, and a sequential control logic circuit connected to the switches and to the electrovalves for controlling the operation of the hydraulic jack and of the auxiliary jacks in a predetermined sequence in response to the actuation of the switches by said control element.

* * * * *